US007209035B2

(12) United States Patent
Tabankin et al.

(10) Patent No.: US 7,209,035 B2
(45) Date of Patent: Apr. 24, 2007

(54) PORTABLE HANDHELD SECURITY DEVICE

(75) Inventors: Ira J. Tabankin, San Marcos, CA (US); John Sutton, Hurst, TX (US)

(73) Assignee: Catcher, Inc., Hamilton, VA (US)

( * ) Notice: Subject to any disclaimer, the term of this patent is extended or adjusted under 35 U.S.C. 154(b) by 0 days.

(21) Appl. No.: 10/885,515

(22) Filed: Jul. 6, 2004

(65) Prior Publication Data

US 2006/0006995 A1 Jan. 12, 2006

(51) Int. Cl.
*G08B 1/08* (2006.01)

(52) U.S. Cl. ..... 340/539.11; 340/539.22; 340/539.25; 340/539.24

(58) Field of Classification Search ..... 304/505, 304/539.22, 539.25, 539.24
See application file for complete search history.

(56) References Cited

U.S. PATENT DOCUMENTS

| | | | | |
|---|---|---|---|---|
| 5,512,834 | A | 4/1996 | McEwan | |
| 6,359,582 | B1 * | 3/2002 | MacAleese et al. | 342/22 |
| 6,417,797 | B1 * | 7/2002 | Cousins et al. | 342/179 |
| 6,681,398 | B1 | 1/2004 | Verna | |
| 6,720,905 | B2 * | 4/2004 | Levitan et al. | 342/22 |
| 7,084,903 | B2 | 8/2006 | Narayanaswami | |
| 2004/0119591 | A1 * | 6/2004 | Peeters | 340/539.26 |
| 2004/0214598 | A1 * | 10/2004 | Parameswaran Rajamma | 455/556.1 |

FOREIGN PATENT DOCUMENTS

| | | | |
|---|---|---|---|
| TW | 416242 | B | 12/2000 |
| TW | 451590 | B | 8/2001 |
| TW | 591926 | B | 6/2004 |
| TW | 228879 | B | 3/2005 |
| WO | WO-2004-034347 | A1 | 4/2004 |

* cited by examiner

*Primary Examiner*—Daryl C Pope
(74) *Attorney, Agent, or Firm*—Morrison & Foerster LLP

(57) ABSTRACT

The present invention provides a portable handheld security device. The security device comprises a central processing unit in communication with a memory storage device, a video display screen, at least one camera, a transmitting device, a receiving device, an input device, and a power supply. The security device further comprises a device for generating ultra wide band ground penetrating radar and/or millimeter wave radar for identifying objects of interest in closed containers. In addition, the transmitting device and the receiving device are ideally capable of selecting between available communication network signals, determining which network signal is the best signal at a given time, and automatically switching between the available signals to maintain optimum reception and transmission quality. The input device has a first set of user-interface controls and a second set of user-interface controls, wherein the first and second sets of user-interface controls are selectively operable by users either independently or simultaneously.

3 Claims, 3 Drawing Sheets

PORTABLE HANDHELD SECURITY DEVICE

BACKGROUND OF THE INVENTION

The present invention relates generally to security systems and more particularly, to methods and devices for carrying out security operations.

In today's world, there are many venues in which safety and security are key concerns. Airports are a prime example. Security systems currently in use in airports include passenger and luggage screening at security check points to ensure that individuals or items posing a security risk are unable to board or otherwise compromise an airplane. Security is also a key concern at U.S. borders, where U.S. Customs and Border Patrol officials attempt to screen incoming cargo containers for items that may pose a national security risk.

Current airport security systems typically require large, stationary equipment to scan luggage and passengers for items posing a security risk. This process is time consuming, and does not afford much flexibility. Moreover, when a luggage bag is abandoned (forgotten or deliberately left behind) in the airport, there is currently no good method for airport security personnel to gather any information about the contents of the bag without opening the bag and physically inspecting its contents. Thus, airport personnel must often call for back up help or a bomb squad to handle the abandoned bag or move the bag to another location for x-ray and controlled physical inspection. Another problem is presented when an individual manages to pass through a security check point without being scanned or checked for identification. It is currently very difficult to locate the individual using existing security devices and systems because security personnel on the floor searching for the individual are often relying on a verbal description, which can be inaccurate, too broad or too narrow. If the individual is not apprehended, under current guidelines the airport must close the terminal and suspend flights until a physical search of the terminal has been completed.

Thus, there exists a need for more complete security systems and devices used therein. The present invention relates to improvements over the security systems and devices described above, and to solutions to the problems raised or not solved thereby.

SUMMARY OF THE INVENTION

The present invention provides a portable handheld security device. The security device preferably comprises a central processing unit in communication with a memory storage device, a video display screen, at least one camera, a transmitting device, a receiving device, an input device, a power supply, and, preferably, a device for generating ultra wide band ground penetrating radar for locating hidden objects, such as objects of interest in closed containers, and displaying images of the hidden objects on the video display screen. In addition, the transmitting device and the receiving device are ideally capable of selecting between available communication network signals, determining which network signal is the best signal at a given time, and automatically switching between the available signals to maintain optimum reception and transmission quality. Further, the input device has a first set of user-interface controls and a second set of user-interface controls, wherein the first and second sets of user-interface controls are selectively operable by users either independently or simultaneously.

The security device further ideally includes a security lock out system, digital full motion video and still-screen image capture, recording, and processing capability, a sound producing device, a sound recording device, a biometric scanner, bar code reading capability, a radio frequency identification reader and interrogator, a global positioning system, a mapping system, and two digital cameras, at least one of which includes the capability for capturing images in infrared light. The security device of the present invention can be used for, among other things, locating dense objects in luggage bags, identifying objects of interest in closed containers, locating hidden life forms, and addressing a security breach. Methods for using the portable handheld security device of the present invention for the aforementioned purposes are also contemplated by the present invention. The present invention further contemplates a method for preventing compromise of a portable handheld security device.

Various other features, objects, and advantages of the present invention will be made apparent to those skilled in the art from the following detailed description and accompanying drawings.

DETAILED DESCRIPTION OF THE INVENTION

Figure 1:
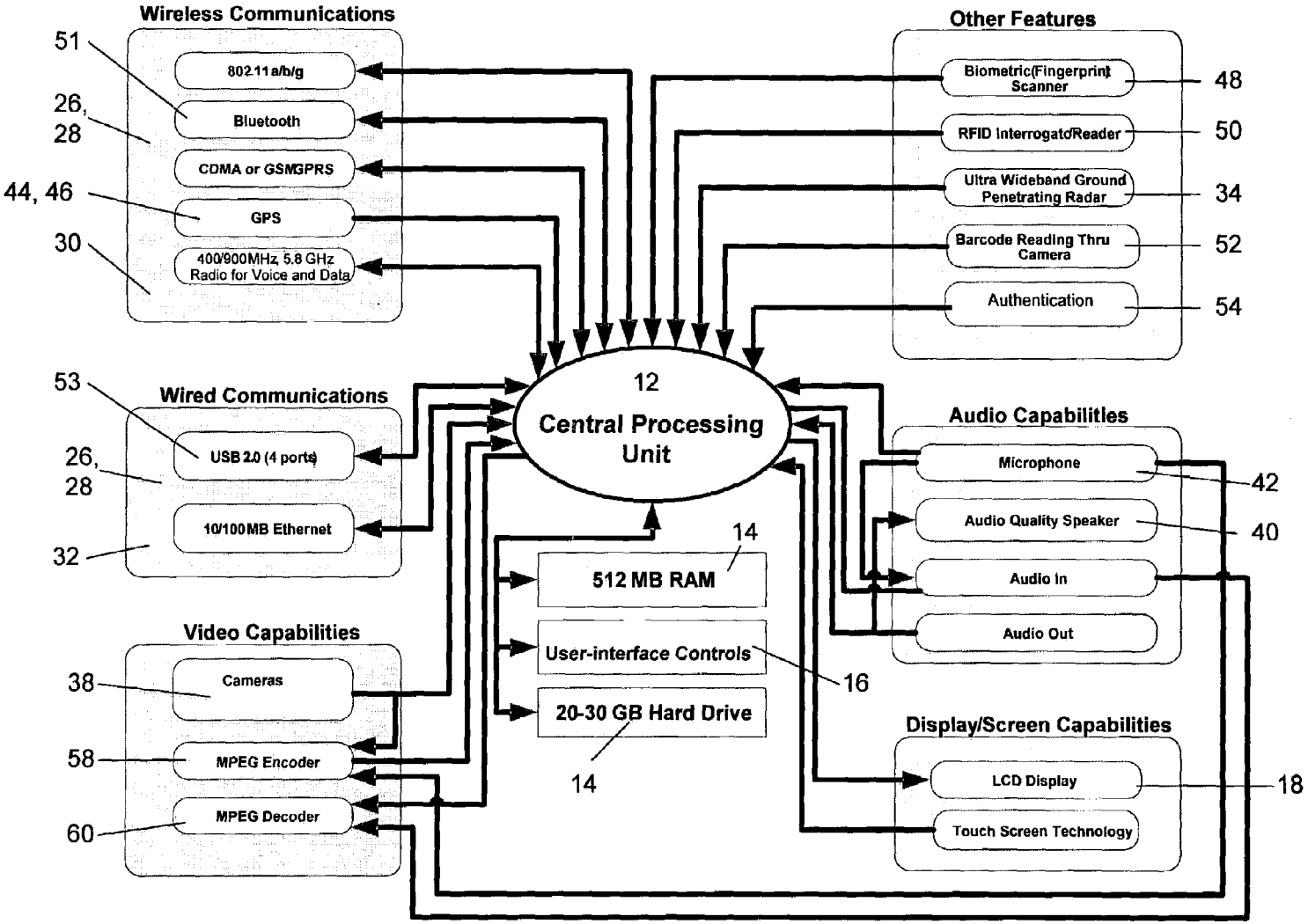
FIG. 1 is a block diagram illustrating a preferred embodiment of the apparatus of the present invention.

Referring now to the drawings, the portable handheld security device 10 of the present invention has a central processing unit 12 that is ideally a mobile processing unit such as an Intel® Pentium® mobile processor. The security device 10 also includes a memory storage device 14 in communication with the central processing unit 12. The memory storage device 14 ideally includes at least 512 megabytes (MB) and 20–30 GB of hard drive space as shown. The security device 10 also includes a power supply 36 preferably comprised of two battery packs in each side handle, for powering the security device 10 and all of its components. The battery packs are ideally rechargeable batteries that can each provide sufficient power to keep the device 10 operational for several hours at a time on a single charge. The battery packs can also preferably be "hot swapped" without shutting the device down.

Figure 2A:
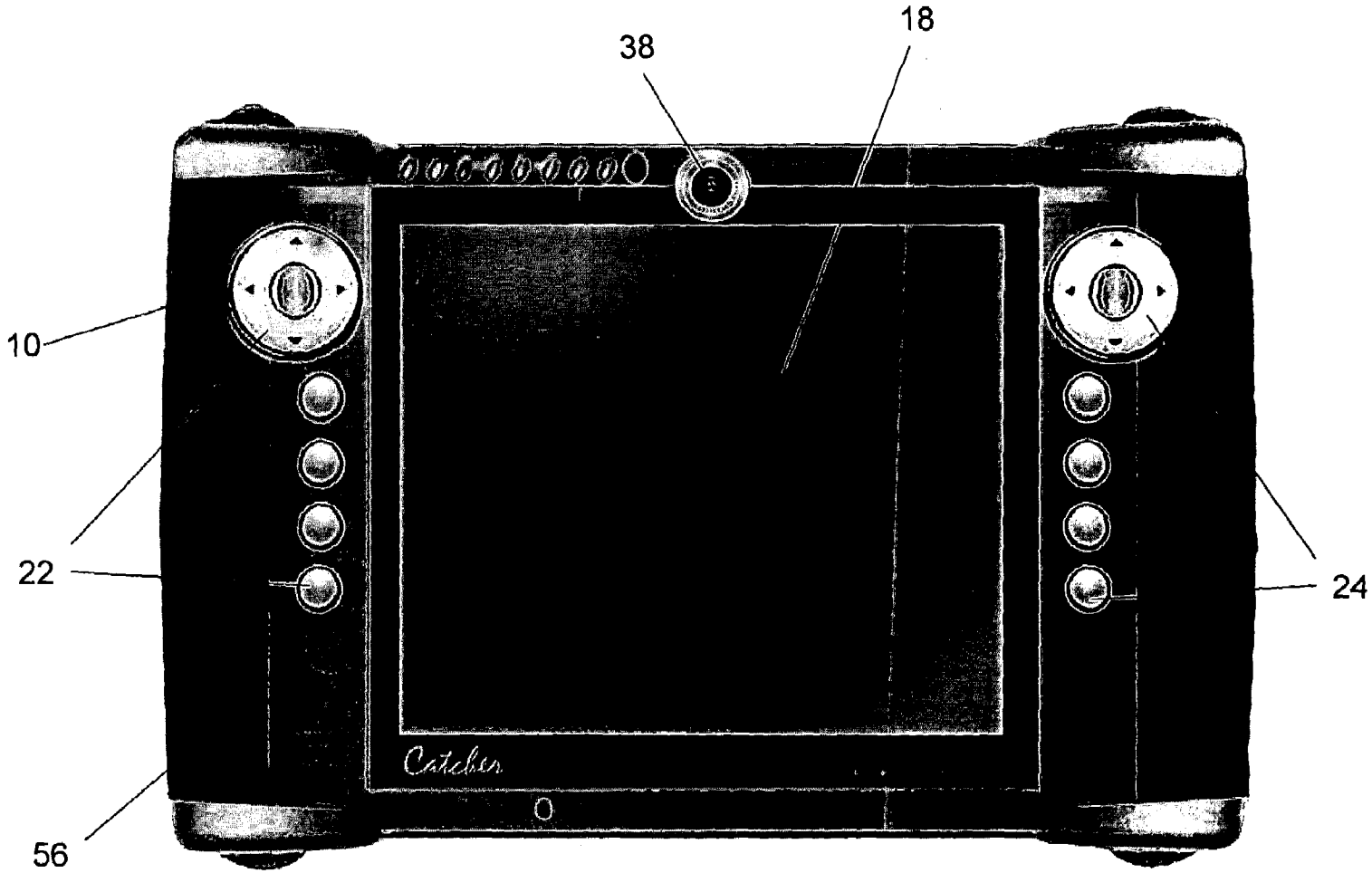
FIG. 2*a* is a front view of a preferred embodiment of the apparatus of the present invention.
Figure 2B:
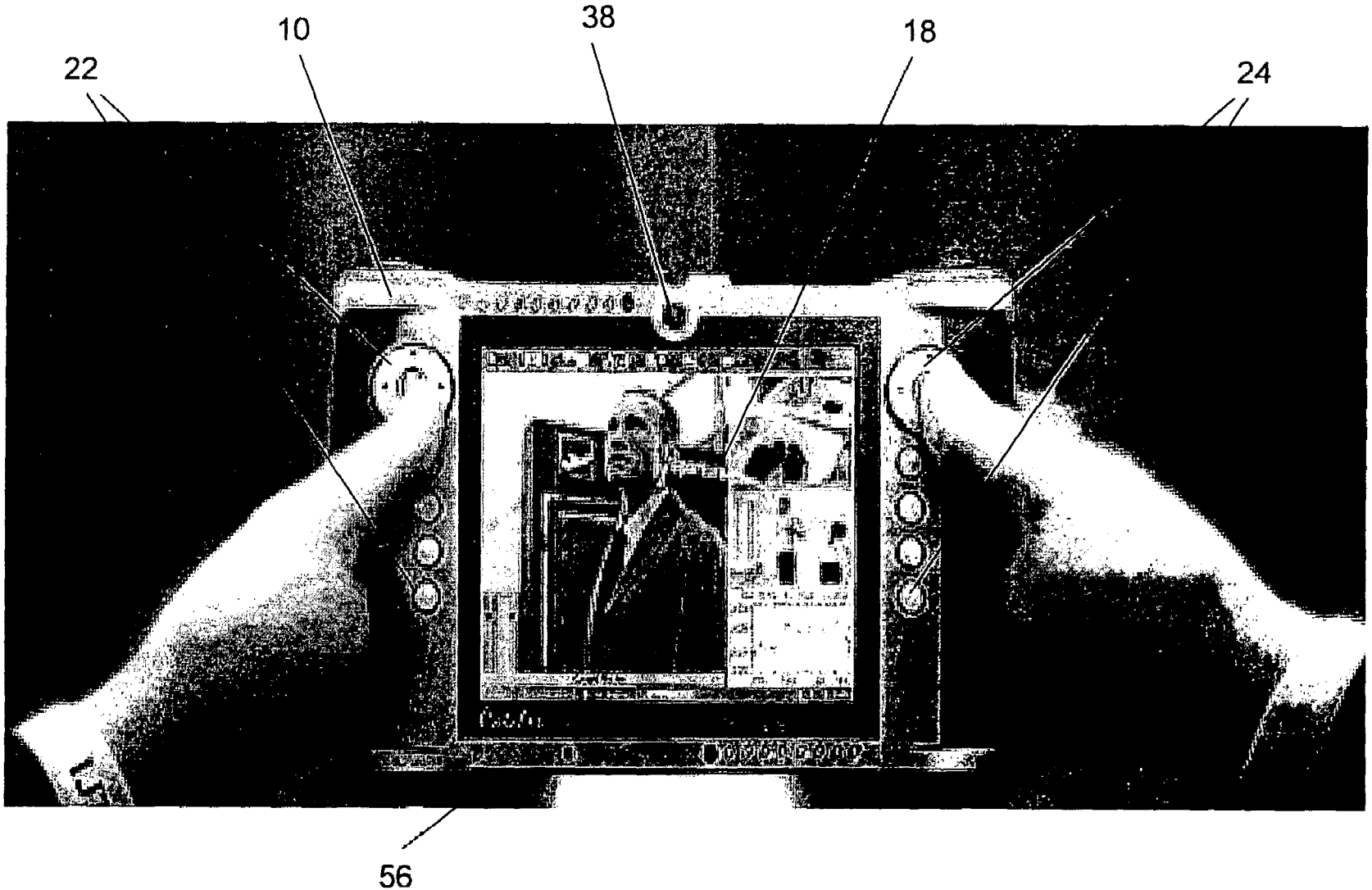
FIG. 2*b* is a front view of a preferred embodiment of the apparatus of the present invention showing the portability and handheld features of the present invention in use.

The security device 10 further includes an input device 16. The input device 16 ideally includes user-interface controls and touch screen technology for manipulating the security device 10 and inputting information into the security device 10. The user-interface controls of the input device 16 are preferably auto-ambidextrous in that there are two sets of user-interface controls, as shown in FIGS. 2*a* and 2*b*. The first set of user-interface controls 22 and the second set of user-interface controls 24 are selectively operable by users either independently or simultaneously. In other words, the user can select a single set of user-interface controls 22, 24, to accommodate left or right-handed tendencies, and use that set of user-interface controls exclusively and independently of the other set of user-interface controls, or the user can select both sets of user-interface controls 22, 24, if the user is ambidextrous, and use both sets simultaneously. Preferably, the security device 10 can sense which set of user-interface controls 22, 24 has first been touched by a user and make that set of user-interface controls the primary set of user-interface controls, thereby allowing the user, consciously or unconsciously, to select a single set of controls to operate independently based on his or her left or right-handed tendencies. If both sets of controls are touched by a user within a predetermined time period such as 2 seconds, the security device 10 allows both sets of controls 22, 24 to operate simultaneously so that a user can use either hand in the middle of an input or manipulation.

The security device 10 also includes a video display screen 18 in communication with the central processing unit 12. The video display screen is ideally a 6.4" LCD screen that supports touch screen technology. Touch screen technology, or a touch screen display, allows a user to simply touch the video display screen 18 to input information or otherwise manipulate the security device 10. The video display screen 18 also preferably supports direct freehand drawing input, allowing a user to write or draw directly on the video display screen 18 to input information. For example, a user could draw a circle around an image displayed on the video display screen 18, and save the image, including the circle, for later use or distribution to others. Picture-in-picture display is preferably also supported by the video display screen. The video display screen 18 is also ideally readable in any lighting condition, including sunlight, to facilitate both indoor and outdoor use.

At least one camera 38 is also provided in communication with the central processing unit 12 for providing video capability for the security device 10. Ideally, the security device 10 has two digital cameras 38 and can capture both still images and full-motion video images. The full-motion video images ideally are captured at a rate of 30 frames per second, and play back at 1–90 frames per second. Panning, zooming, fast forward, reverse, normal play, and pause features are also preferably supported by the security device 10. At least one of the cameras 38 ideally can operate in infrared light, and at least one of the cameras can ideally operate in normal and low light. Pictures taken in normal, low and infrared light can either be mixed within the same full-motion video image, or the user can switch between the normal, low and infrared light modes as an image is being captured. Each camera ideally has a minimum of 2 mega pixels resolution, and up to 8 hours of full-motion video can ideally be stored in the security device 10. The video capability of the present invention preferably also includes at least a Motion Picture Experts Group (MPEG) encoder and decoder 58, 60.

The security device 10 also includes a transmitting device 26 and a receiving device 28 in communication with the central processing unit 12. The transmitting and receiving devices 26, 28 can ideally securely transmit and receive information using wireless devices 30, such as radio frequency (RF) wireless network cards, or wired devices 32, such as ethernet cable connections. Many different wireless local area networks (WLANs) can be used with the security device 10, including without limitation 802.11a/b/g, 802.11 "super g," 802.15.3a, Global System for Mobile Communications and General Packet Radio Service (GSM/GPRS), 3G, ultra wide band, Bluetooth™, and CDMA One. The security device 10 also ideally supports 400/900 MHz and 5.8 GHz radio for voice and data transmission and receipt. Further, the security device 10, using wireless devices 30, is ideally capable of selecting between available communication network signals, determining which network signal is the best signal at a given time, and automatically switching between the available signals to maintain optimum reception and transmission quality. For example, the security device 10 ideally has middleware that measures the received signal strength of the various network cards and can select the best signal unless the user chooses to "lock in" a particular source. If the security device 10 starts using an RF wireless network card and encounters interference, it can seamlessly switch to another wireless transmission mode without the user knowing a change was made. The security device 10 can also operate whether or not the transmitting and receiving devices 26, 28 are enabled. In other words, the security device 10 can also operate as a stand alone unit. Preferably, when operating as a stand alone unit, the security device 10 continues to look for wireless or wired networks with which it can authenticate. If such a network is located, the security device 10 will preferably exchange pass codes and information with the corresponding network server to transition from stand alone to network operation.

The security device 10 further includes a device for producing ultra wide band ground penetrating radar 34 and millimeter wave radar in communication with the central processing unit 12. Ideally, the security device 10 uses an ultra wide band ground penetrating radar unit that has been modified to work in a lower power smaller scale version or a millimeter wave radar. Traditional ultra wide band ground penetrating radar units are typically used to non-destructively examine the earth for items buried underground, such as pipes, tree roots, and archeological artifacts. Ground penetrating radar is also commonly used to examine the internal configuration of concrete structures such as bridges and roadways. The ultra wide band ground penetrating radar unit 34 of the present invention is intended to be used for locating and identifying hidden objects, such as items of interest in closed, non-metal containers. For example, the ultra wide band ground penetrating radar unit 34 could be used to non-destructively examine the contents of a piece of luggage at an airport. The millimeter wave radar can be used to non-destructively examine the contents of a cargo container coming into the United States through U.S. Customs and Border Patrol ports. Such examination provides an efficient way to inspect the contents of the luggage or cargo container for items of interest, such as items that may pose a security risk. The ultra wide band ground penetrating radar unit 34 can ideally operate within 5 meters from the container or other item being examined, and can ideally penetrate up to 10 meters into the container or other item. Other RF sources, such as the global positioning system 44 and the transmitting and receiving devices 26, 28, are preferably unaffected by the operation of the ultra wide band ground penetrating radar unit 34.

Many other devices and capabilities are also ideally included in the security device 10 of the present invention. Audio capability, including a sound producing device 40, such as speakers, and a sound recording device 42, such as a digital sound recorder including a microphone, is preferably included. A global positioning system 44, a mapping system 46, a biometric scanner 48 including a National Institute of Standards and Technology (NIST) approved fingerprint sensor, a radio frequency identification (RFID) interrogator and reader 50, a Bluetooth™ RF link for headsets and printers 51, bar code reading capability 52, two universal serial bus (USB) ports 53, an Ethernet port and a software authentication system 54 are also preferably provided in the security device 10. [In addition, the security device 10 is preferably a complete personal computer (PC) that runs on Microsoft® XP operating system and supports voice, data, video conferencing, email, Microsoft® Office® files, any software that operates under or over Microsoft® XP operating system, forms generation, and document scanning. It should be understood, however, that the security device 10 of the present invention can be configured to run on any operating system including Linux, MacOS, Solaris and Unix.

All of the above-described features of the present invention are ideally contained in a lightweight, handheld housing 56 that is durable enough to meet Military Standard 801F, waterproof, and able to withstand virtually all weather conditions and climates with an operating temperature range of −30 to +50° Celsius. The entire security device 10 is also ideally very lightweight, preferably between 2.5 and 5 pounds including the battery. The handheld, lightweight, wireless security device 10 can easily be carried and operated using one or both hands, as shown in FIG. 2*b*. The security device 10 can be easily carried and used by personnel in, for example, transportation security, transportation operations, corporate security, education security, first responder organizations, government agencies, the Department of Defense and the Department of Homeland Security.

The security device of the present invention can be used in a number of ways and for a number of purposes, and thus the present invention also contemplates various methods of using the security device. For example, a method for identifying objects of interest in closed containers, such as but not limited to luggage bags at airports or cargo containers at U.S. Customs and Border Patrol ports, is contemplated by the present invention, as well as a method for locating hidden life forms, such as security-breaching individuals or other suspects. Another significant method contemplated by the present invention is a method for addressing a security breach, such as but not limited to a security breach at an airport. The methods are further described using the examples below.

EXAMPLE 1

Identifying Objects of Interest in Closed Containers

The ability to identify objects of interest in closed containers is an important security issue. For example, airport security personnel often find abandoned luggage bags. Because abandoned luggage bags could contain items that pose very serious security risks, such as bombs, airport personnel must treat such luggage very carefully. Today, airport personnel have three options for handling the abandoned bag: pick up and move the bag, call for back-up help from inside or outside the airport, or call the bomb squad. With any of these current options, the airport personnel must make a decision without first knowing anything about the contents of the bag.

Using the security device of the present invention, however, the airport personnel could scan the bag with ultra wide band ground penetrating radar and, view the images produced by the radar in real-time to see if any objects of interest or concern, particularly dense objects, are present in the bag. If there are no dense objects, the airport personnel should be able to pick up the bag and move it to another location to be x-rayed and physically inspected. If there are dense objects, the airport personnel would then know they need to call for back up help or call the bomb squad because an object of interest or concern is in the bag. Once help arrives, the responding persons will be able to see the images produced by the radar, giving them additional information for deciding how best to proceed.

This same scenario could happen in other locations as well, including other transportation centers, office buildings, trade and social conventions, sporting events, education venues, power plants and hospitals. Personnel at any of these locations could easily carry the security device of the present invention for use in similar situations. This use of the security device is also particularly useful for non-destructively examining cargo containers at U.S. Customs and Border Patrol ports for objects of interest or concern.

EXAMPLE II

Locating Hidden Life Forms

Locating hidden life forms can also be an important security measure. For instance, a suspect may try hiding from his pursuers behind a wall or around a corner of a building where traditional surveillance equipment cannot see him. The security device of the present invention, however, will be able to see the hiding suspect using the infrared capability of at least one of its cameras. With a camera in infrared mode, the user can scan an area in which a suspect may be hiding and capture infrared images of the area. If a suspect, or any other life form, is present, the infrared image will produce an indicative heat signature. Thus, if a suspect was hiding around a corner, the infrared camera image of the corner area would show a heat signature indicating that a life form was near the corner. This feature of the security device could be used in any situation wherein locating hidden individuals or other life forms is desired.

EXAMPLE III

Addressing a Security Breach

Being able to adequately address a security breach is an essential function of security personnel in all secured venues. For example, almost every day in an airport someplace in the world, someone breaches the airport security system by walking through a security checkpoint without stopping. Today, when such a security breach happens, the breaching individual's picture is usually captured by a security camera. When airport security personnel realize a breach has occurred, they typically send a message to the rest of the security personnel in the airport, usually by sounding a chime or flashing selected lights in the airport, to alert them of the breach. The security command and control center then describes the breaching individual to all of the security staff, usually by two-way radio. Some locations in the airport, however, may not be able to adequately receive the two-way radio signal and thus some security personnel could miss the description entirely. In addition, the verbal description, as opposed to a visual description or actual photograph, of the breaching individual may not be accurate or may be too broad or too narrow, making it difficult for airport security to locate and apprehend the breaching individual. If the breaching individual is not apprehended, the Federal Aviation Administration and/or the Transportation Safety Administration require that the airport terminal be cleared so that a physical search can be performed. This procedure can close an airport terminal for several hours, costing hundreds of millions of dollars in lost revenues and delaying hundreds of flights.

If the airport security personnel carried security devices according to the present invention, however, it would be much easier to quickly locate and apprehend the breaching individual. For instance, the picture from the security camera could be sent from the security command and control center to the security devices carried by all security personnel. Thus, all security personnel would be able to see an actual picture of the breaching individual, instead of relying on a verbal description. The video feeds from the security camera could also be sent directly to the security devices carried by all security personnel, so that security personnel could view breaching individual's picture taken at any location, not just from the security command and control center. Further, once the security personnel find an individual who appears to be the person in the picture, the security personnel could take a photograph using the security device and send the picture to the command and control center and/or to other personnel carrying security devices and confirm that they have located the correct individual. Using the security device's biometric scanner, the security personnel could also ask the individual to provide a fingerprint, which the security device could then send to an NIST server to verify that the individual is who he or she claims to be.

The present invention further contemplates a method for preventing compromise of the security device using a security lock out system. Preventing compromise of the device is an important function of the device because it helps ensure that the device can only be used by those authorized to use it. Ideally, the command and control center for the security personnel at a secured venue would provide an authorized individual with a time limit for logging into or authenticating with the security device. If the time limit expires before the authorized individual logs in or authenticates, the display screen on the security device ideally turns black and an innocuous message such as, "please standby" appears. The microphone, sound recording device, cameras, and global positioning system or other location sensor are ideally activated so that the security command and control center can locate the security device, as well as see and hear everything the security device records so that if the device is taken by a person with nefarious intent, their activities could be monitored without their knowledge.

While the invention has been described with reference to preferred embodiments, it is to be understood that the invention is not intended to be limited to the specific embodiments set forth above. It is recognized that those skilled in the art will appreciate certain substitutions, alterations, modifications, and omissions may be made without parting from the spirit or intent of the invention. Accordingly, the foregoing description is meant to be exemplary only, the invention is to be taken as including all reasonable equivalents to the subject matter of the invention, and should not limit the scope of the invention.

What claimed is:

1. A portable handheld security device comprising:

a central processing unit in communication with a memory storage device.

a video display screen, at least one camera, a transmitting device, a receiving device, an input device, a power supply, and a device for generating at least one type of radar to locate hidden objects, and to produce images of the hidden objects on the video display screen, wherein the input device has a first set of user- interface controls and a second set of user-interface controls, and wherein either the first and/or the second set of user-interface controls is automatically activated based on conscious or unconscious user selection within a predetermined period of time.

2. A method for preventing compromise of a portable handheld security device, the method comprising:

providing a network system having a command and control center;

providing a portable handheld security device in communication with the command and control center, the portable handheld security system having a central processing unit in communication with a memory storage device, at least one camera, a sound recording device, a transmitting device, a receiving device, an input device, a global positioning system, and a power supply;

providing means for logging in to the network system using the portable handheld security device;

applying a time limit to the means for logging in to the network system;

activating the camera for producing images, the sound recording device for recording sounds, and global positioning system for locating the portable handheld security device if the time limit expires before the means for logging in to the network system are satisfied; and transmitting the images produced by the camera, the sounds recorded by the microphone, and the location of the security device determined using the global positioning system to the command and control center.

3. A method for preventing compromise of a portable handheld security device, the method comprising:

providing a network system having a command and control center;

providing a portable handheld security device in communication with the command and control center, the portable handheld security system having a central processing unit in communication with a memory storage device, at least one camera, a sound recording device, a transmitting device, a receiving device, an input device, a global positioning system, and a power supply;

logging in to the network system using the portable handheld security device;

applying a time limit to the logging in to the network system;

activating the camera for producing images, the sound recording device for recording sounds, and global positioning system for locating the portable handheld security device if the time limit expires before the means for logging in to the network system are satisfied; and transmitting the images produced by the camera, the sounds recorded by the microphone, and the location of the security device determined using the global positioning system to the command and control center.

* * * * *